United States Patent [19]

Skvarenina

[11] 4,009,586

[45] Mar. 1, 1977

[54] METHOD AND APPARATUS FOR PREVENTING CONDENSATION FROM FORMING ABOUT THE PERIPHERY OF A FREEZER DOOR

[76] Inventor: John A. Skvarenina, 2639 W. Augusta, Chicago, Ill. 60622

[22] Filed: Feb. 3, 1975

[21] Appl. No.: 546,768

[52] U.S. Cl. ..... 62/80; 62/89; 62/277; 62/282

[51] Int. Cl.[2] ..... F25D 21/12

[58] Field of Search ..... 62/80, 81, 282, 277, 62/89, 238, 161; 98/40 C, 108

[56] References Cited

UNITED STATES PATENTS

| | | | |
|---|---|---|---|
| 1,847,109 | 3/1932 | Holbrook | 62/277 |
| 2,420,240 | 5/1947 | Haggerty | 62/277 |
| 2,441,080 | 5/1948 | Peglow | 62/277 |
| 2,444,667 | 7/1948 | Philipp | 62/277 |
| 2,449,384 | 9/1948 | Hursey et al. | 62/277 |
| 2,462,705 | 2/1949 | Abeling | 62/282 |

*Primary Examiner*—John J. Camby
*Assistant Examiner*—Larry I. Schwartz
*Attorney, Agent, or Firm*—Olson, Trexler, Wolters, Bushnell & Fosse, Ltd.

[57] ABSTRACT

The embodiment of the invention disclosed herein is directed to a new and improved method and apparatus for preventing condensation from forming about refrigerator and freezer doors. Warm air produced by the compressor of a refrigerator or freezer unit is channeled either directly or indirectly therefrom to flow vertically along the peripheral sealed edges of the freezer door to prevent condensation from developing therealong. The heated air from the compressor is directed through a vent or outlet port formed in a kick plate or through outlets formed in the housing at a location near the bottom vertical edges of the door. This will provide vertical columns of warm air to flow therealong and prevent condensation.

10 Claims, 4 Drawing Figures

METHOD AND APPARATUS FOR PREVENTING CONDENSATION FROM FORMING ABOUT THE PERIPHERY OF A FREEZER DOOR

BACKGROUND OF THE INVENTION

This invention relates generally to refrigeration systems, and more particularly, to a method and apparatus for preventing condensation from developing along the sealed edge of a refrigerator or freezer door.

It is well known that refrigerator and freezer cabinets are constructed in such a manner that the outer surfaces of the compartment along the marginal sealed edges of the doors are cooled to a temperature below the dew point of the surrounding air. This causes the moisture in the air to condense along the exterior edge of the door or along the housing of the refrigerator or freezer immediately adjacent the sealed edge of the door.

Heretofore, means for heating the peripheral edge around the door opening of a freezer housing have been provided so that a relatively low dew point is obtained to prevent condensation from occurring around the door opening. Such prior art structures incorporate either electric heating elements or tubing which forms part of the refrigeration cycle.

In the case of an electric heating element, the cost and energy consumption of such refrigerators or freezers is high. Furthermore, should the electric heating element become inoperative, it is often impossible or impractical to repair the same because of the general construction of the refrigerator or freezer. In many instances, some manufacturers provide two such electrical heating elements embedded into the housing near the periphery of the door opening. Therefore, should one of the heating elements become defective, an external connection can be made to the other heating element to again provide means for preventing condensation from occurring.

When a part of the refrigerating cycle, such as the condensor tubing, is embedded in the periphery of the refrigerator or freezer opening, a substantial savings in cost and electrical power used to operate the unit is realized. However, should a break occur in the embedded tubing, the entire refrigerating system must be completely dismantled or discarded. In either event, the cost to the user is substantial.

SUMMARY OF THE INVENTION

Accordingly, it is an object of this invention to provide new and improved method and apparatus for preventing condensation from occurring along the edges of the door of a refrigerator or freezer unit.

A feature of this invention is the utilization of the warm air inherently generated by the compressor during the refrigerating cycle of operation. This air is directed from the compressor upwardly along the vertical edges of the freezer or refrigerator door to provide a warm air flow thereacross and prevent condensation from occurring.

Many other objects, features and advantages of this invention will be more fully realized and understood from the following detailed description when taken in conjunction with the accompanying drawings wherein like reference numerals throughout the various views of the drawings are intended to designate similar elements or components.

DETAILED DESCRIPTION OF THE ILLUSTRATED EMBODIMENTS

Figure 1:
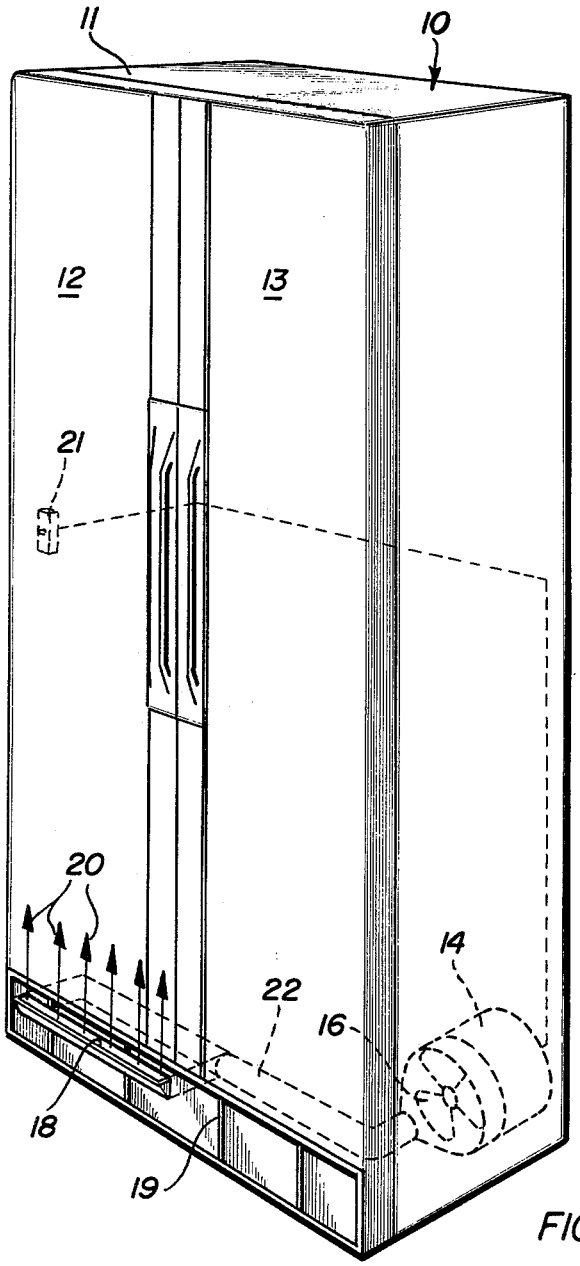
FIG. 1 is a perspective view of a conventional refrigerator-freezer combination of the side-by-side type having two horizontally spaced-apart vertical doors and illustrates one form of the present invention.

Referring now to FIG. 1, there is seen a domestic refrigerator-freezer combination of the side-by-side type and is designated generally by reference numeral 10. The freezer-refrigerator unit 10 can be of any of the well-known conventional types. The refrigerator-freezer combination has a housing 11 with a pair of vertically disposed hinged doors 12 and 13. The door 13 provides access to the refrigerator portion on the unit while the door 12 provides access to the freezer portion of the unit. A motorized refrigerating component designated generally by reference numeral 14 is mounted at the lower portion of the housing 11, this generally being a sealed motor compressor unit, as is well-known in the art. The refrigerating unit 14 provides both the cooling cycle for the refrigerating side and the freezing cycle for the freezer side. As is well-known in the art, the compressor unit 14 is cooled by either convection to the air surrounding the unit or by a cooling fan blade, here designated generally by reference numeral 16.

In accordance with this invention, the warmed air produced by the compressor is directed through a vent 18 formed in a pick plate 19 located at the bottom portion of the housing 11. In the embodiment shown in FIG. 1, the vent 18 extends substantially the entire width of the freezer door 12 and provides a rising column of warm air along the vertical edges of the door, the column of air here being indicated by the arrowed lines 20. A duct 22 may be provided to direct the warm air from the compressor 14 to the vent 18.

A door switch 21 is provided to de-energize the compressor motor 14 and fan 16 when the freezer door 12 is opened. This prevents warm air from being introduced into the interior of the freezer compartment. When the door is closed, the compressor motor 14 and fan 16 are again energized. While the kick plate 19 illustrates only a single louver or vent 18 for directing warm air upwardly along the freezer door 12, it will be understood that a second vent may be provided for directing a stream of air along the refrigerator door 13.

Figure 2:
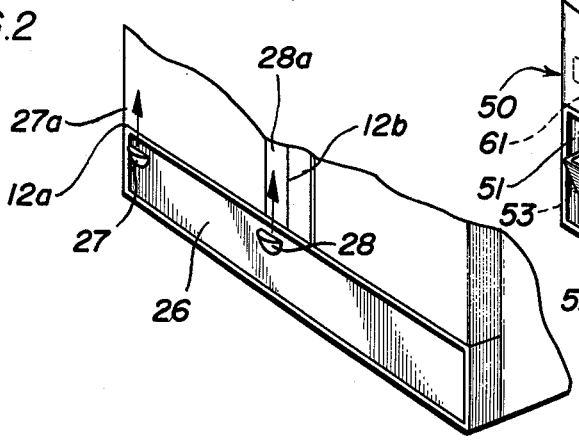
FIG. 2 illustrates an alternate form of a kick plate which can be used in the refrigerator of FIG. 1.

FIG. 2 illustrates an alternate form of kick plate which can be constructed in accordance with the principles of this invention. Here a kick plate 26 is provided with a pair of spaced-apart cup-shaped outlets 27 and 28 which are arranged to be in vertical registry with the edges 12*a* and 12*b* of the door 12. The outlets 27 and 28 provide two discrete columns of warm air designated generally by the arrowed lines 27*a* and 28*a*. Here again, a third outlet or cup-shaped vent may be provided to direct a rising column of warm air along the right-hand edge of the refrigerator door 13.

Figure 3:
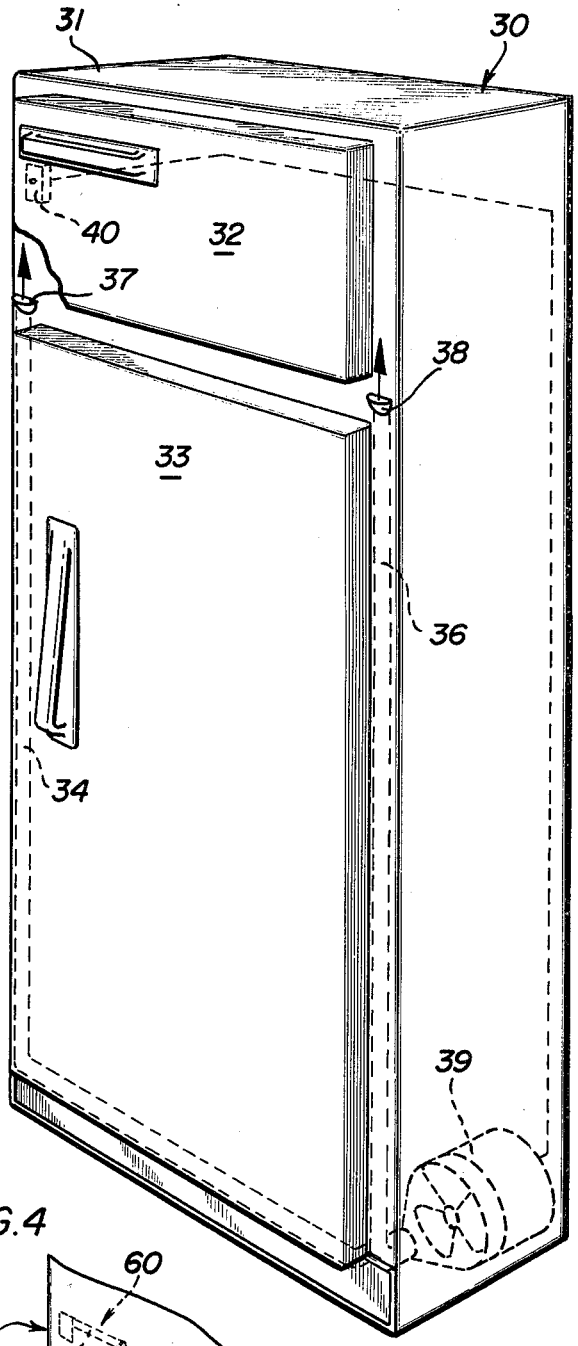
FIG. 3 illustrates another alternate configuration of the present invention.

Referring now to FIG. 3, there is seen a conventional refrigerator-freezer unit designated generally by reference numeral 30. The refrigerator-freezer unit 30 is of the horizontal freezer type having a freezing compartment positioned above a refrigerating compartment within a housing 31. However, it will be understood that the freezer compartment may be on the bottom. The freezing compartment is provided with a freezer door 32 while the refrigerating compartment is provided with a refrigerator door 33. In this embodiment, duct means 34 and 36 are formed along the side of the walls of the housing 31 and are directed upwardly to terminate at outlets 37 and 38, respectively. The duct means 34 and 36 may be formed by either providing voids in the insulating material within the housing walls or they can be formed by plastic tubing, or the like. The outlets 37 and 38 are here shown as being cup-shaped in configuration and positioned immediately adjacent the vertical edges of the freezer door 32.

The warm air is again obtained from a sealed motor compressor unit 39 located at the lower rear portion of the housing 31. A switch 40 is actuated by the freezer door 32 and de-energizes the compressor motor 39 or a blower fan associated therewith to prevent warm air from the outlets 37 and 38 from entering the freezer compartment.

Figure 4:
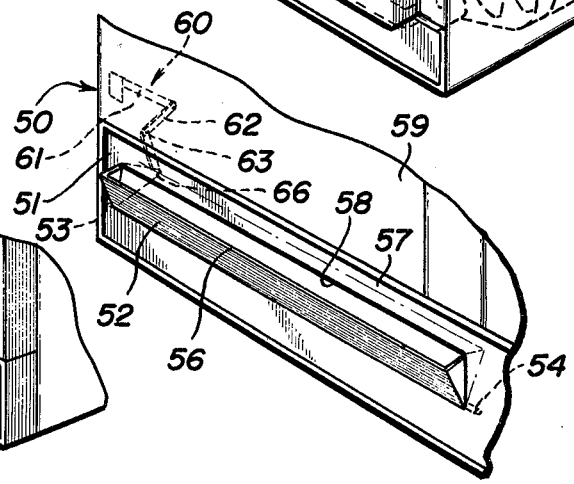
FIG. 4 is a fragmentary perspective view of still another alternate embodiment of the present invention.

Referring now to FIG. 4, there is seen still another alternate embodiment of the present invention. Here a fragmentary portion of a refrigerator unit 50 is provided with a kick plate 51 which has a louvered element 52 pivotally secured thereto. The louvered element is here illustrated as being pivoted along its bottom edge at pivot points 53 and 54 which may form a hinge line therebetween. The louver then is adapted to rotate about this hinge line so that the top edge 56 thereof can abut the upper portion 57 of the kick plate 51 and close off an opening 58 formed for the louver. This pivotally movable louver is actuated by opening of a door 59 through suitable pivot and link elements 60. In the illustrated embodiment, the link means 60 may comprise a first link 61 coupled to the door 59 at one end thereof and to a second pivotally mounted member 62 at the other end thereof. The member 62 is pivoted intermediate its ends at 63. The opposite end of the pivotal member 62 is coupled to a flange or arm 66 so that the louver will close when the door 59 is opened.

The advantages obtained by utilizing the apparatus of this invention are, for example, power savings in that no electrical heating element is required, cost savings in that manufacturing costs are reduced by eliminating the need of embedding electrical heating elements or refrigerating tubing around the periphery of the refrigerator or freezer openings, and minimum or no service requirements other than those to service the refrigerator unit.

What has been described is a simple and efficient means for removing and/or eliminating the formation of moisture from accumulating along the exterior edge of a door or along the exterior housing of a refrigerator or freezer immediately adjacent the sealed edge of the door. While several specific embodiments of the present invention have been illustrated herein, it will be understood that variations and modifications may be effected without departing from the spirit and scope as set forth in the following claims.

The invention is claimed as follows:

1. In a refrigeration unit, the combination comprising: a housing for defining a refrigeration space, an opening formed in said housing, a door secured to said housing and over said opening, said door providing a seal about the periphery of said opening, a compressor unit secured to said housing and giving off heat to the surrounding air exterior of said refrigeration space, air flow means for directing the heated air produced by said compressor unit to flow along at least one edge of said door and the housing portion immediately adjacent thereto for preventing condensation from developing therealong and along said housing portion, and switch means actuated by said door for de-energizing said compressor and temporarily terminating the warm air flow when said door is open.

2. In a refrigeration unit as set forth in claim 1 further including blower means associated with said compressor unit for directing said heated air through said air flow means.

3. In a refrigeration unit as set forth in claim 1 wherein said air flow means includes a kick plate at the bottom of said housing, said kick plate having outlet means formed therein for directing the heated air upwardly along the vertical edges of said door.

4. In a refrigeration unit as set forth in claim 3 wherein said outlet means is formed by a single elongated louver having an extent at least as wide as said door.

5. In a refrigeration unit as set forth in claim 3 wherein said outlet means formed in said kick plate is formed by a pair of cup-shaped outlet ports located in registry with the vertical edges of said door for directing warm air upwardly therealong.

6. In a refrigeration unit as set forth in claim 1 wherein said air flow means includes channel means formed in said housing for directing the heated air produced by said compressor therethrough, and outlets formed at the end of said channels, said outlets being located adjacent the bottom portion of vertical edges of said door for providing a vertical column of heated air for preventing condensation therealong and along said housing immediately adjacent thereto.

7. In a refrigeration unit as set forth in claim 6 wherein said outlets are formed on opposite sides of said door.

8. In a refrigeration unit the combination comprising: a housing for defining a refrigeration space, an opening formed in said housing, a door secure to said housing and over said opening, said door providing a seal about the periphery of said opening, a compressor unit secured to said housing and giving off heat to the surrounding air exterior of said refrigeration space, and air flow means for directing the heated air produced by said compressor unit to flow along at least one edge of said door and the housing portion immediately adjacent thereto for preventing condensation from developing therealong and along said housing portion, said air flow means comprising a pivotal louver, and means responsive to opening and closing of said door and coupled to said pivotal louver for closing said pivotal louver when said door is open and for opening said pivotal louver when said door is closed.

9. A method of preventing condensation from forming about the outer periphery of a freezer door and the housing immediately adjacent thereto comprising the steps of: operating a compressor for producing a refrigerating cycle, cooling the compressor by transferring the heat therefrom to the surrounding air, directing the heated air produced by said compressor along the edges of a freezer door, and de-energizing said compressor in response to opening of said door.

10. A method of preventing condensation from forming about the outer periphery of a freezer door as set forth in claim 9 further including the step of channeling the warm air from said compressor through ducts, and discharging the warm air through outlets at the end of said ducts.

* * * * *